United States Patent [19]

Guillaumin

[11] 4,144,819

[45] Mar. 20, 1979

[54] TRUCK BOLSTER

[75] Inventor: Jean-Claude Guillaumin, L'Etang la Ville, France

[73] Assignee: Societe des Acieries de Paris et D'Outreau, Paris, France

[21] Appl. No.: 778,606

[22] Filed: Mar. 17, 1977

[30] Foreign Application Priority Data

Mar. 19, 1976 [FR] France ..... 76 08130

[51] Int. Cl.[2] ..... B61F 1/12; B61F 5/04; B61F 5/16; B61F 5/50

[52] U.S. Cl. ..... 105/230; 105/199 C; 105/200

[58] Field of Search ..... 105/182 R, 190 R, 196, 105/197 R, 197 D, 197 DB, 199 C, 199 CB, 206 R, 224 R, 224 A, 226, 227, 230, 200; 267/3, 4; 308/137

[56] References Cited

U.S. PATENT DOCUMENTS

| | | | |
|---|---|---|---|
| 700,992 | 5/1902 | Symons | 105/230 X |
| 1,407,551 | 2/1922 | Laughlin | 105/230 |
| 1,733,675 | 10/1929 | Stertzbach | 105/230 |
| 1,971,768 | 8/1934 | Chiles | 105/230 |
| 2,036,859 | 4/1936 | Drenning | 105/230 |
| 3,338,183 | 8/1967 | Boissier | 105/230X |

FOREIGN PATENT DOCUMENTS

| | | | |
|---|---|---|---|
| 1340882 | 9/1963 | France | 105/199 C |
| 1452860 | 8/1966 | France | 105/199 C |
| 1548033 | 10/1968 | France | 105/199 C |
| 1548047 | 10/1968 | France | 105/199 C |

*Primary Examiner*—Francis S. Husar
*Assistant Examiner*—Howard Beltran

[57] ABSTRACT

Railway rolling-stock truck bolster or cross-member provided with a bearing for receiving the vertical pintle of the vehicle, wherein at least one of a first pair of front and rear sectors of the upper edge of the bearing, facing the front and rear end of the vehicle, respectively, is substantially tangent, in a central area, to the upper edge of a corresponding lateral wall portion of the cross member, at least one of the sectors of the first front and rear sectors of the upper edge of the bearing is connected via a pair of skew surface portions each beginning in each one of two lateral portions of said sector to a pair of inclined lateral surfaces of the cross member.

4 Claims, 7 Drawing Figures

15
VII
VI
V
17
3
2
19
IV
18
16

8
6'
5'
4'
5c'
4c
19
7
3
9

TRUCK BOLSTER

BACKGROUND OF THE INVENTION

This invention relates to a truck bolster or cross member for railway vehicle, of the type comprising a central bearing receiving a vertical pintle of said vehicle, wherein at least one of a first pair of sectors, namely a front and a rear sector, of an upper edge of said bearing, disposed at the front and rear thereof with respect to a direction of travel of the vehicle, is substantially tangent, in a central area, to an upper edge of a corresponding vertical lateral wall portion of the cross member.

Cast cross members provided with pintle bearings have already been widely used in the prior art technique. In a present construction these cross members have a flat top portion adapted to receive the pintle bearing. When relatively important stress is applied to this cross member, notably when the vehicle hits or is hit by another vehicle, the right angle formed between this upper flat portion and each vertical wall portion of the cross member is subjected to particularly high flexion stress detrimental to the strength and useful life of the cross member. Among the methods proposed for avoiding this inconveniences, the one consisting in forming an insert bearing secured by welding is particularly advantageous and furthermore facilitates greatly the machining operations. However, even in its most sophisticated version, this method seems to impose at least partly the final shape of the surface portions connecting the bearing to the cross member, which can therefore not assume the best possible configuration; in addition, this method is likely to develop distortions in the bearing which reduce considerably the advantage deriving from the greater machining facility.

SUMMARY OF THE INVENTION

It is the essential object of the present invention to provide a cross member equipped with a pintle bearing for railway rolling stock and presenting an improved strength and a longer useful life.

The truck cross member for railway vehicle according to this invention is characterized primarily in that at least one of said first pair of sectors is connected via a pair of skew surfaces beginning each in two lateral areas of said sector to a pair of inclined lateral wall portions of said cross member.

With the structure broadly defined hereinabove the torque resulting from collision forces applied to the centre of said bearing can be transmitted under much better conditions to the complete cross member. The maximum stress densities are reduced appreciably and a considerable reduction in the weight of the truck is obtained.

BRIEF DESCRIPTION OF DRAWING

Other features and advantages characterizing this invention will appear as the following description proceeds with reference to the attached drawings in which.

DESCRIPTION OF THE PREFERRED EMBODIMENT

Figure 1:
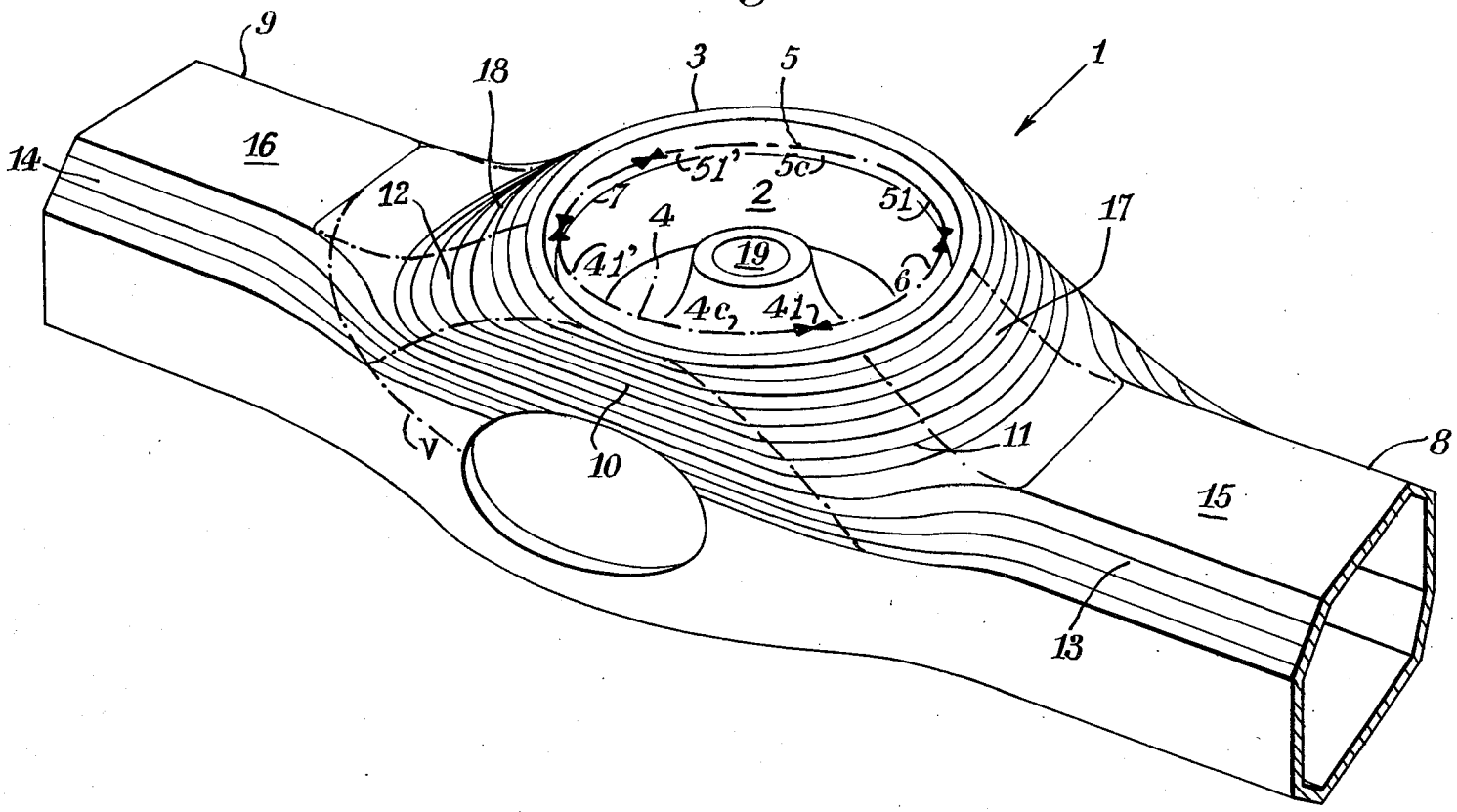
FIG. 1 illustrates diagrammatically in perspective view a typical embodiment of one portion of a cross member on which level lines are drawn in order to facilitate the understanding of the principle of this invention.
Figure 2:
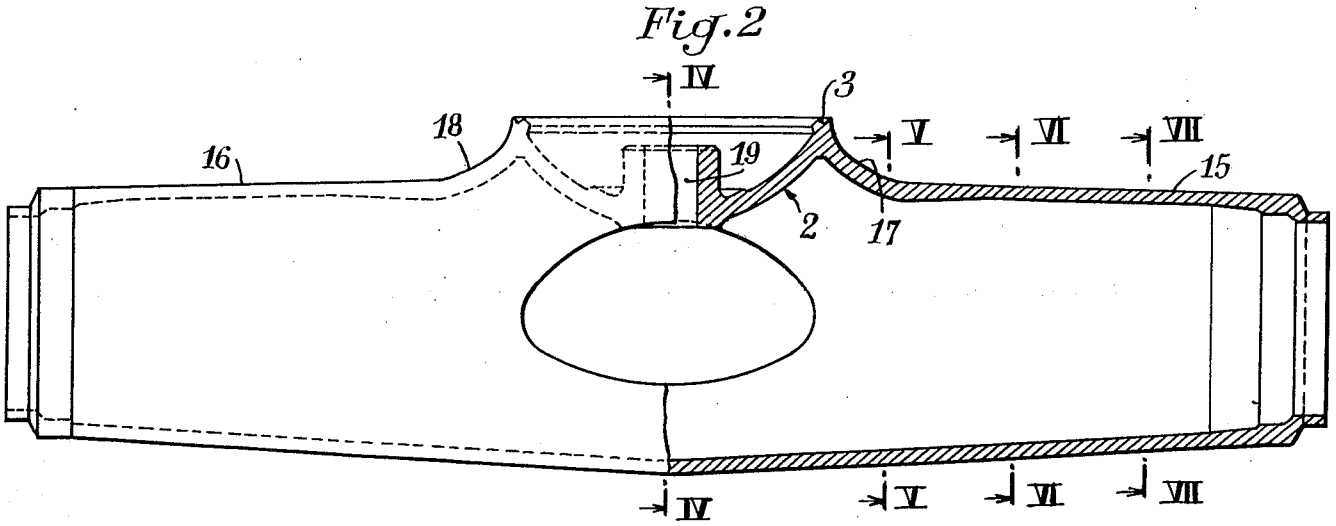
FIG. 2 is a side and vertical sectional view of such a cross member.
Figure 3:
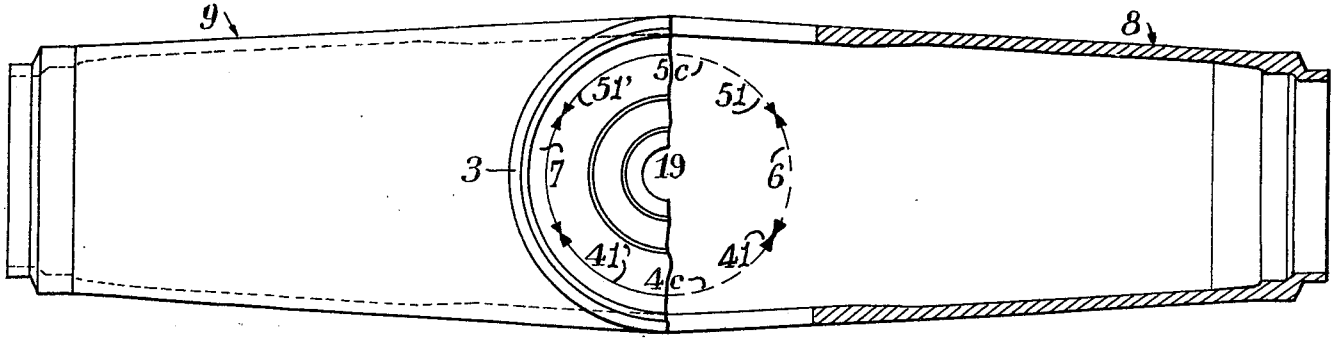
FIG. 3 is a plan and horizontal sectional view of this cross member.
Figure 5:
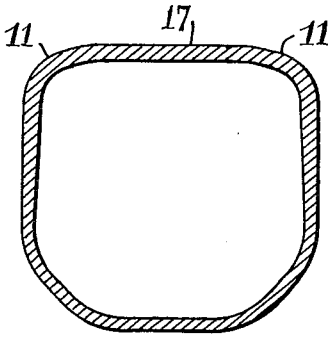
FIG. 5 is a sectional view along the lines V—V of FIG. 2.
Figure 7:
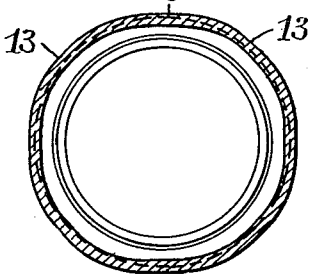
FIG. 7 is a sectional view along the lines VII—VII of FIG. 2.
Figure 4:
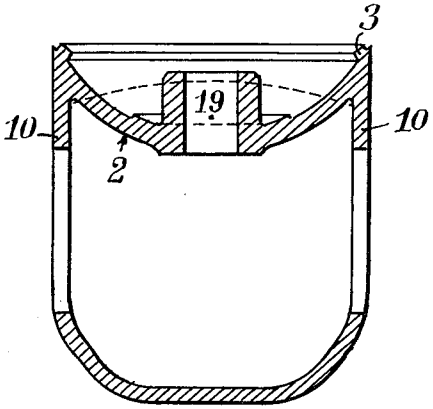
FIG. 4 is a sectional view along the lines IV—IV of FIG. 2.
Figure 6:
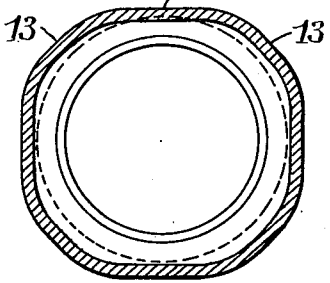
FIG. 6 is a sectional view along the lines VI—VI of FIG. 2.

The bogie-truck bolster or cross member 1, of which only the main central portion is illustrated, is intended notably for constructing railway rolling stock trucks and comprises a central bearing member 2 for mounting the central pintle of the railway vehicle or the like.

The top or upper edge 3 of this bearing 2 may be divided, as illustrated, into four sectors, i.e. a first pair of sectors 4, 5 constituting so to say the front and rear ends of the vehicle, respectively, and second pair of so-called lateral sectors 6, 7 each directed toward one of the side arms 8, 9 of cross member 1.

At least one sector of the first pair, for example sector 4, is substantially tangent, in its central portion 4c, to the upper edge of a corresponding lateral vertical wall 10 (bounded by phantom line only for the sake of affording a clearer understanding of the present specification) of the cross member. According to this invention, at least one sector of this first pair, for example sector 4, is connected via a pair of skew surfaces 11, 12 (also designated by phantom lines, without any physical meaning) each beginning in one of the two lateral areas 41, 41' of this sector 4, to a pair of lateral inclined wall portions 13, 14 of this cross member. In like manner the central portion 5c of sector 5 is substantially tangent to the upper edge of a corresponding lateral vertical wall and connected via a pair of skew surfaces each beginning, in one of the two lateral areas 51, 51' of this sector 5, to a pair of lateral inclined wall portions of this cross member similar to portions 13, 14.

At least one sector of the second pair of lateral sectors 6, 7 bounded on the upper edge 3 of the bearing by the first pair of sectors 4, 5 is connected preferably to an upper horizontal wall portion 15, 16 of the corresponding lateral arm 8, 9 of the cross member through the medium of a continuously derivable (in the mathematical meaning) connecting surface 17, 18, i.e. a surface having a continuously varying orientation without any sharp corners.

At least one of the skew surfaces 11, 12 and at least one of said connecting surfaces 17, 18 contiguous thereto join each other to form a continuously derivable surface at least in a predetermined vicinity V of the centre 19 of bearing 2.

Similarly, at least one 10 of the vertical wall portions and at least one 12 of said skew surface portions 11, 12 contiguous thereto join each other to form together a continuously derivable surface in the vicinity V of the centre 19 of said bearing.

Each one of said inclined lateral wall portions 13, 14 is advantageously inclined at 45° to a horizontal direction. At a predetermined distance from the centre 19 of said bearing 2, i.e. beyond the above-mentioned vicinity V, the cross member comprises a polygonal and preferably octogonal section.

Of course, it will readily occur to those conversant with the art that various modifications and changes may be brought to the specific form of embodiment described and illustrated herein by way of example, without departing from the basic principles of the invention as set forth in the appended claims.

What is claimed as new is:

1. A truck cross member for railway vehicle, comprising:

a pair of longitudinal horizontal upper wall portions, a longitudinal horizontal lower wall, two longitudinal vertical walls, said longitudinal horizontal lower wall being connected to each longitudinal vertical wall first and second pairs of longitudinal inclined wall portions, each pair of inclined wall portions connecting said pair of longitudinal horizontal upper wall portions to one of said two longitudinal vertical walls, and a center bearing composed of a bowl having a central pintle receiving hole and a circular peripheral lip, said center bearing being disposed between said two longitudinal horizontal wall portions, said lip being, in each one of two first areas thereof, tangential to an upper edge of a corresponding one of said two longitudinal vertical walls, said lip being, in each one of two second areas thereof, smoothly connected to a corresponding one of said two longitudinal horizontal wall portions through one of two connecting surfaces, and said lip being further, in each one of four third areas thereof, smoothly connected to said first and second pairs of longitudinal inclined wall portions via corresponding first and second pairs of sloping surfaces, each sloping surface sloping downwardly from a corresponding one of said four third areas of said lip, each delimited between two adjacent first and second areas, and each sloping surface having a lower portion which is in skewed relationship to said corresponding third area, whereby the said lower portion of said sloping surface merges with one of said longitudinal inclined wall portions.

2. A truck cross member according to claim 1, wherein said connecting surfaces and said sloping surfaces form together a smooth surface.

3. A truck cross member according to claim 1, further comprising two lower longitudinal inclined walls each connecting a corresponding one of said two longitudinal vertical walls to said longitudinal horizontal lower wall.

4. A truck cross member according to claim 3, wherein said longitudinal inclined wall portions and said lower longitudinal inclined walls have planar surfaces therebetween.

* * * * *